US005197205A

United States Patent [19]

Spada et al.

[11] Patent Number: 5,197,205

[45] Date of Patent: Mar. 30, 1993

[54] CONTINUOUS DRYER

[75] Inventors: Massimiliano Spada; Giberto Garbagnati, both of Milan, Italy

[73] Assignee: VRV S.P.A., Milan, Italy

[21] Appl. No.: 717,668

[22] Filed: Jun. 19, 1991

[51] Int. Cl.[5] ..... F26B 11/12

[52] U.S. Cl. ..... 34/182; 34/183; 34/135; 34/58

[58] Field of Search ..... 34/179, 180, 181, 182, 34/183, 109, 58, 134–142, 128

[56] References Cited

U.S. PATENT DOCUMENTS 1,672,218 6/1928 How ..... 34/179
2,510,057 6/1950 Baker et al. ..... 34/183
2,531,578 11/1950 McIlvaine ..... 34/182
4,276,701 7/1981 Takacs et al. ..... 34/183
4,420,892 12/1983 Braun et al. ..... 34/183
4,727,658 3/1988 Ullum ..... 34/183

*Primary Examiner*—Albert J. Makay
*Assistant Examiner*—Denise L. F. Gromada
*Attorney, Agent, or Firm*—Ladas & Parry

[57] ABSTRACT

The continuous dryer of the invention is essentially characterized in that in addition to blades, said rotor is provided with at least one centrifuging element extending along the entire axis of the rotor advantageously in a helical pattern in the product discharge direction, said centrifuging element being shaped in the form of a rib with a height less than the height of said blades and so calculated as to act as a device for limiting the product layer present on the heated surface of said cylinder.

15 Claims, 3 Drawing Sheets

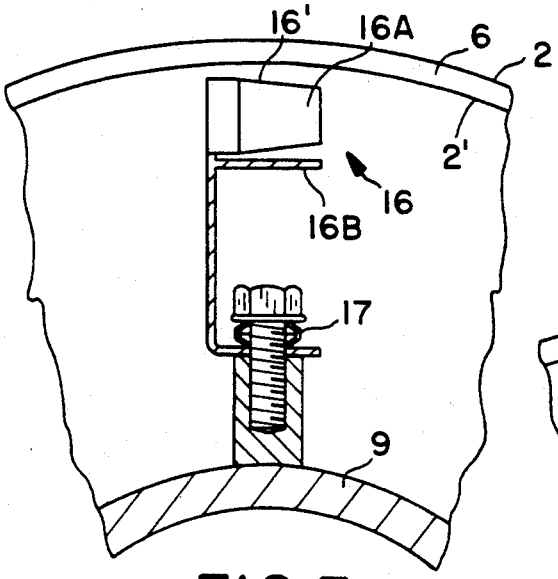
FIG. 3
FIG. 3'
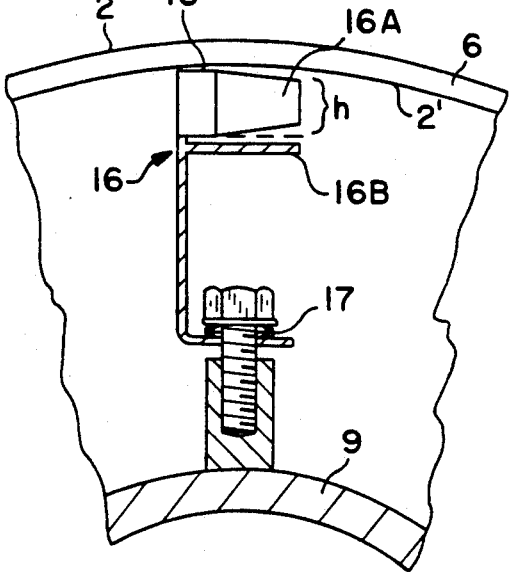
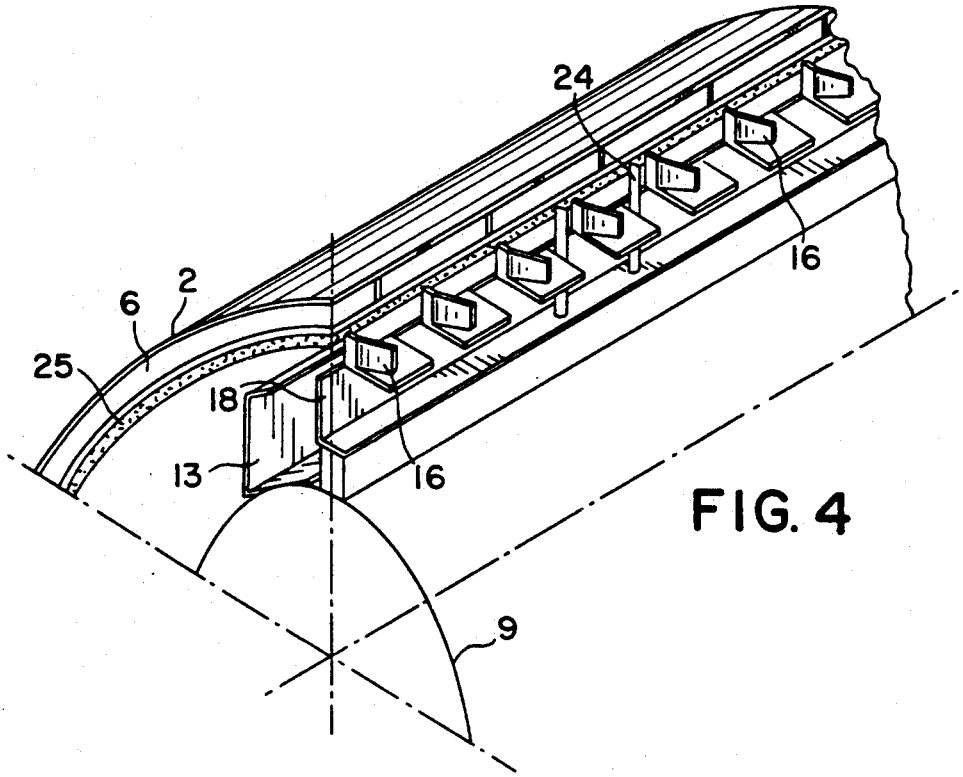
FIG. 4

CONTINUOUS DRYER

FIELD OF THE INVENTION

This invention relates to a continuous dryer of the substantially horizontal axis type especially designed and constructed for drying products in general and in particular pasty and pulverulent liquid products.

BACKGROUND OF THE INVENTION

Various types of horizontal axis dryers are known, consisting substantially of a cylinder having a heated surface and within which a possibly heated rotor is rotated, this being provided with a plurality of blades the purpose of which is to keep the product to be treated in a state of agitation so that it is brought turbulently into contact with the heated surface while at the same time being advanced along the cylinder axis towards discharge, cocurrently or countercurrently fed hot gas possibly being used.

These types of conventional dryer do not always achieve satisfactory drying of all types of products, particularly thermolabile or rheologically critical products, because the thickness, turbulence, dynamic and contact conditions of the layer of product under treatment lying at the cylinder heating surface are such as not to produce correct heat transfer and in particular result in the formation of a deposit at said surface by virtue of the different treatment times which the product undergoes.

This deposit results in soiling and in particular deterioration of the product, with consequent fall-off of heat transfer.

In these known dryers the product must never be statically at rest on the hot wall and the distance therefrom of the agitation element must tend to zero in order to act on the entire layer, with the result that a further problem encountered is that the difference in thermal expansion due to the temperature difference between the cylinder and rotor results in a variation in the position of the blades relative to the heated surface of the cylinder. This obviously results in irregular or incorrect and non-constant turbulence of the product under treatment, resulting in a loss of dynamicity of the system.

A further drawback of conventional dryers is that the centrifuging of the product under treatment and its distribution over the heated surface is partial, random and limited and depends on the blade inclination, with consequent poor contact with the cylinder. Again, in conventional dryers gas-product separation takes place externally with consequent problems of cost, space requirement and handling.

An object of the present invention is to provide a continuous dryer in which the drawbacks encountered in conventional continuous dryers are overcome.

This and further objects will be apparent to the expert of the art on reading the ensuing description.

BRIEF DESCRIPTION OF THE PRESENT INVENTION

The continuous dryer according to the invention is of the type comprising a horizontal or substantially horizontal static cylinder provided with means for the direct or indirect heating of the surface which is to come into contact with the product under treatment; means for supporting said cylinder on a floor; opposing cylinder closure heads provided in proximity to the product loading and discharge apertures; and, within said cylinder, a rotor provided with prevalently helically arranged blades and with end hubs, one of said hubs being provided with means for transmitting rotation to said rotor, and is essentially characterised in that in addition to the blades said rotor is provided with at least one centrifuging element extending along the entire axis of said rotor, said centrifuging element being in the form of a rib having a height less than the height of said blades and so calculated as to act as a device for limiting the product layer present on the heated surface of said cylinder.

BRIEF DESCRIPTION OF THE DRAWINGS

The dryer of the invention is illustrated by way of non-limiting example in the figures of the accompanying drawings, in which:

FIGS. 3 and 3' show a detail of the expansion mounting of a blade;

FIG. 4 is a cut-away view of a part of the rotor showing its blades mounted on a single block and a rib;

DETAILED DESCRIPTION

Figure 1:
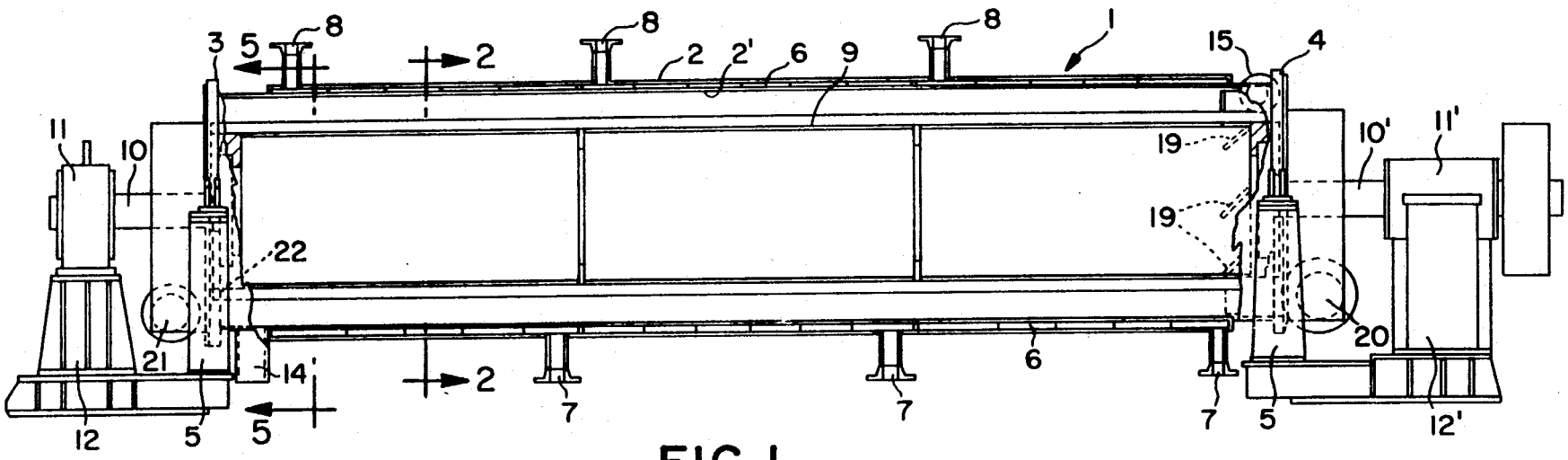
FIG. 1 is a longitudinal section through the overall dryer.

With reference to said figures, the dryer indicated overall by the numeral 1 includes a cylinder 2 of horizontal axis provided with closure heads 3 and 4. The cylinder 1 is supported by elements 5 resting on a common surface. Circumferentially about said cylinder there is provided a chamber 6 for the passage of heating oil, which is fed and discharged through ports 7 and 8 provided along said cylinder 2.

In the illustrated example the chamber 6 is divided into several compartments, each compartment being provided with an inlet and discharge port 7 and 8, to provide differential heating of the cylinder 2 if desired.

A rotor 9 is arranged axially within the cylinder 2 and is provided with hubs 10, 10' which pass through the heads 3 and 4 and are supported by bearing systems 11, 11' each supported by its own structure 12, 12', which is independent of the elements 5 supporting the cylinder 2.

The reason for providing separate and independent support element for the cylinder 2 and rotor 9 is basically that as these latter two components are at different temperatures, they undergo different degrees of expansion, which could affect the correct operation of the unit. A further reason for separate supports is the extent of the dynamic forces in play when the rotor rotates at high speed.

Figure 2:
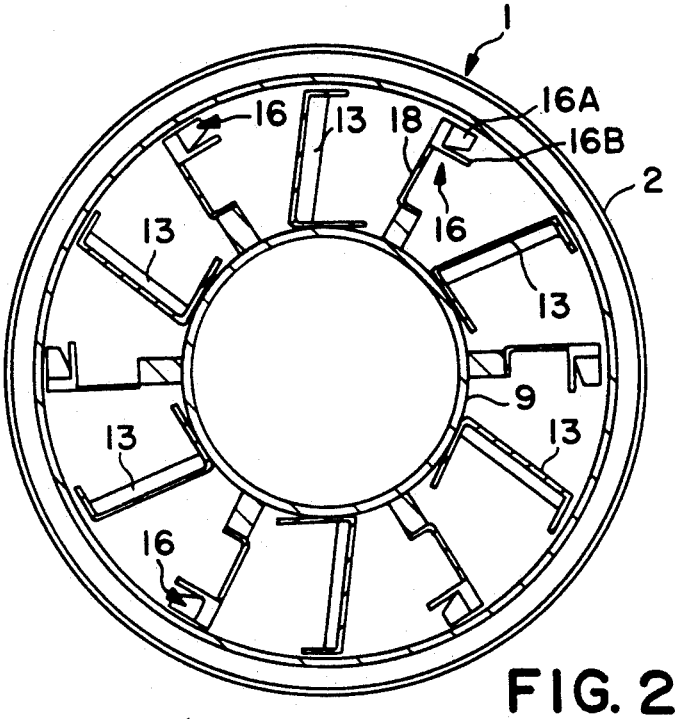
FIG. 2 is an enlarged schematic cross-section on the line II—II of FIG. 1.
Figure 2A:
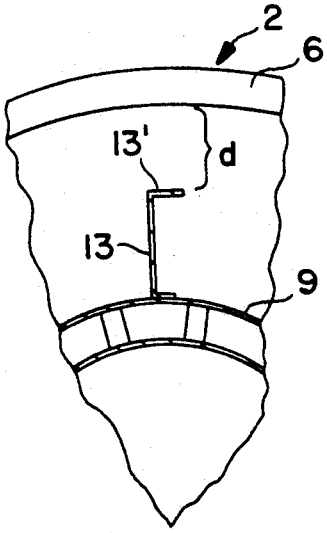
FIGS. 2*a* and 2*b* are schematic illustrations of two preferred embodiments of the ribs, shown in section.
Figure 2B:
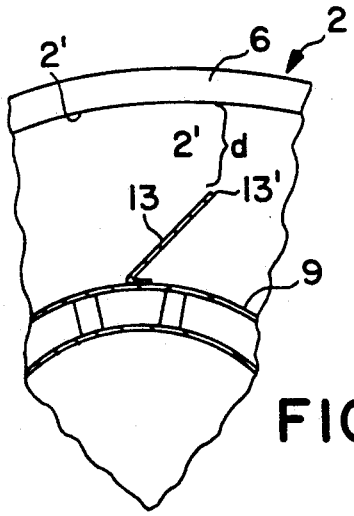

As can be seen from FIG. 2, the rotor 9 comprises a plurality of ribs 13 arranged variously relative to the rotor and extending substantially along the entire length of the roller. The product is fed through a loading aperture 15. The shape of the ribs 13 can be suitably designed to prevent dynamic return with depression, and material deposition on them, together with prolonged centrifugal moments. Schematic examples of possible arrangements of the ribs 13 are shown in FIGS. 2*a* and 2*b*.

What is essential according to the present invention is that the outer edge 13' of each rib 13, independently of its configuration, is spaced from the heated inner surface 2' of the cylinder 2 by a distance d equal to the required thickness of the layer of material under treatment in the interspace between the surface 2' and the edge 13'.

On the rotor 9 there is also provided a plurality of blades 16 in a prevalently helical arrangement with one or more starts, their particular structure being such that the end edge 16' is maintained always substantially tangential to or scraping the heated surface 2' when the rotor is moving. As shown in FIGS. 3, 3' each blade is fixed onto the rotor 9 via a cup spring 17 or like elements. Such a structure enables the position of the edge 16' relative to the surface 2' to be controlled independently of the state of the rotor 9.

When the rotor 9 is at rest (FIG. 3) the spring 17 is in an expanded state and the end 16' is spaced from the heated surface 2'. This obviously has no influence on operation as the dryer 1 is inoperative. When the rotor 9 is moving (FIG. 3') the centrifugal force compresses the spring 17 and the edge 16' is brought into the vicinity of the heated surface 2'.

The required travel of the edge 16' of the blade 16 is calculated on the basis of various factors, the strength of the springs 17 also being calculated on the basis of these factors.

The purpose of the blades 16, as is well known, is to maintain the treated product in a stage of agitation throughout the entire cross-section of the product layer 25 while at the same time urging the product towards discharge. This is achieved in conventional dryers by inclining the blade by between 0° and 45° to provide an identical thrust throughout the entire layer.

As there may be accumulations of product and therefore an undesirable layer increase while progressing along the longitudinal axis of the dryer, the blade must be able to automatically handle this product accumulation.

This is achieved according to the present invention by giving the individual blades 16 different inclinations and different heights h as illustrated schematically in FIGS. 3, 3'; and 4 in which the blades are given a twist or fixing angle which is different for different blade heights so as to generate both a propulsive force and a sustentation force. With such construction, the blades (16) include (1) an after portion (16A) extending at an angle to the base portion and (2) a transverse portion (16B). As is well known, the product turbulence is a function of the number of blades, which when viewed in development during rotation must ideally cover the entire heated surface. In current dryers this turbulence is achieved with individual blades each requiring its own mounting and adjustment, thus creating a limitation on the number of blades.

According to the present invention a large number of blades can be formed by blanking and bending them from a single element 18 (FIG. 4) fixed to the rotor 9 either by way of the expansion system already described with reference to FIGS. 3 and 3', or not.

With particular reference to FIG. 1, a thrust and centrifuging blade 19 is fixed rigidly to the rotor 9 in proximity to the head 4, to provide air/product separation and discharge the air through an aperture 20 provided in the bottom of the head 4.

If the dryer 1 is to be used with supplementary hot air, an aperture 21 is provided in the head 3 for feeding this air into a distribution channel 22 which feeds said air into the cylinder in a radial direction.

Figure 5:
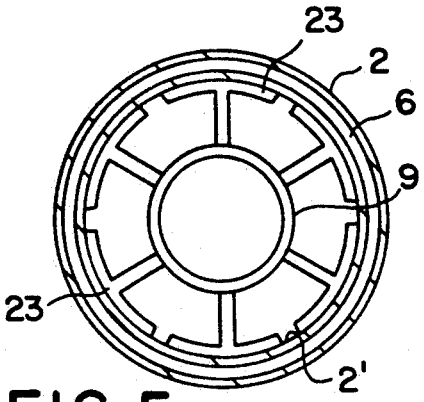
FIG. 5 is a schematic section on the line V—V of FIG. 1.

With particular reference to FIG. 5, barrier blades 23 are provided on the rotor 9 in the same plane immediately upstream of the discharge aperture 14 to hinder the product exit by obliging it to pass over the top of these blades. In practice these blades can also consist of a single ring.

To reduce mechanical work due to the cutting and impact force, the blades have a sharpened working edge. In addition, to increase the product heat transfer surface, in combination with the blades there are provided preferably corner-section grinding elements 24 or cam-shaped devices (not shown), mounted in any manner on the rotor and arranged to hammer against the heat transfer wall by centrifugal force.

We claim:

1. A continuous dryer for a product, said dryer comprising:

a) a substantially horizontal static cylinder, having product loading and discharge apertures in said static cylinder and heating means associated with said static cylinder for heating a cylindrical inner surface of said static cylinder;

b) a substantially cylindric rotor in said static cylinder and defining a substantially cylindrical gap with said inner surface;

c) at least two angularly displaced blade arrangements on said rotor, each arrangement extending along a generatrix of the substantially cylindric rotor and for substantially the whole length of the rotor and each arrangement comprising a plurality of spaced blade means (16) inclined with respect to a plane perpendicular to said rotor and extending within said gap for a certain radial height;

d) driving means for transmitting rotation to said rotor;

e) at least one centrifuging means (13) extending between the two blade arrangements along a generatrix of the substantially cylindric rotor and for substantially the whole length of the rotor and extending within said gap for a radial height less than said certain radial height of said plurality of blade means.

2. A continuous dryer according to claim 1 comprising: a plurality of blade arrangements wherein each arrangement comprises a succession of mutually spaced inclined blades means and a plurality of centrifuging means alternating with said pluralities of blade arrangements.

3. A continuous dryer according to claim 1, wherein said heating means includes means for differential heating of said cylindrical inner surface.

4. A continuous dryer according to claim 1, wherein said cylinder and said rotor are supported by independent support means.

5. A continuous dryer according to claim 1, wherein at least some of said blades means (16) are resiliently urged away from said heated surface.

6. A continuous dryer according to claim 1, wherein the blades means (16) comprise blades having active portions (16A) of differing heights and inclinations.

7. A continuous dryer according to claim 1, wherein said blade means comprise a group of blades (16) which are formed from a single piece of sheet material.

8. A continuous dryer according to claim 1, further comprising aperture means (20, 21) for feeding hot air into said gap concurrent the product advancement.

9. A continuous dryer according to claim 1, further comprising gas separating means (19) located on the rotor at the loading aperture for separating gases from the product.

10. A continuous dryer according to claim 1, further comprising barrier means (23) on said rotor partially intercepting said gap.

11. A continuous dryer according to claim 1, wherein the blades (16) have a sharpened edge facing the product layer.

12. A continuous dryer according to claim 1, further comprising grinding means (24) in association with the blades (16).

13. A continuous dryer according to claim 1, further comprising elongated grinding means (24) in association with the blades (16).

14. A continuous dryer according to claim 1, wherein the centrifuging means comprise ribs (13) which are formed from a single-piece structure.

15. A continuous dryer according to claim 1, wherein the blades means (16) comprise blades having a base portion (28), an active portion (16A) and a transverse portion (16B).

* * * * *